United States Patent [19]

Davert et al.

[11] 4,272,215

[45] Jun. 9, 1981

[54] REMOTE CONTROL COUNTERSINK ADJUSTMENT

[75] Inventors: Edward J. Davert, Seattle; Wilbur L. Gants, Renton, both of Wash.

[73] Assignee: The Boeing Company, Seattle, Wash.

[21] Appl. No.: 26,122

[22] Filed: Apr. 2, 1979

[51] Int. Cl.[3] ..... B23B 47/00

[52] U.S. Cl. ..... 408/14; 29/65; 408/11; 408/241 S; 409/184; 409/210; 409/214

[58] Field of Search ..... 409/184, 210, 218, 171, 409/214; 408/14, 11, 16, 10, 241 S; 29/65; 33/185 R; 227/58; 318/466

[56] References Cited

U.S. PATENT DOCUMENTS

| | | | |
|---|---|---|---|
| 2,033,484 | 3/1936 | Schauer et al. | 408/14 |
| 2,909,082 | 10/1959 | Booth | 408/14 X |
| 3,224,104 | 12/1965 | Platt | 33/185 X |
| 3,478,624 | 11/1969 | Stafford | 408/241 S |
| 3,563,133 | 2/1971 | Asman | 409/184 X |
| 3,566,827 | 3/1971 | Moseley | 409/218 |
| 3,595,132 | 7/1971 | Thacker | 408/11 X |

FOREIGN PATENT DOCUMENTS

| | | | |
|---|---|---|---|
| 2514064 | 10/1976 | Fed. Rep. of Germany | 408/241 S |
| 465277 | 6/1975 | U.S.S.R. | 408/10 |
| 618259 | 8/1978 | U.S.S.R. | 408/14 |

*Primary Examiner*—William R. Briggs

*Attorney, Agent, or Firm*—Morris A. Case; Bernard A. Donahue

[57] ABSTRACT

A surface of a wedge acts as a stop to limit travel of a spindle on an automatic riveting machine. A drive mechanism moves the wedge back and forth to vary the heighth of the wedge, and the same mechanism simultaneously moves a rod back and forth to act on a transducer, and transmit an electrical signal to give a digital readout of the change in heighth of the wedge.

3 Claims, 5 Drawing Figures

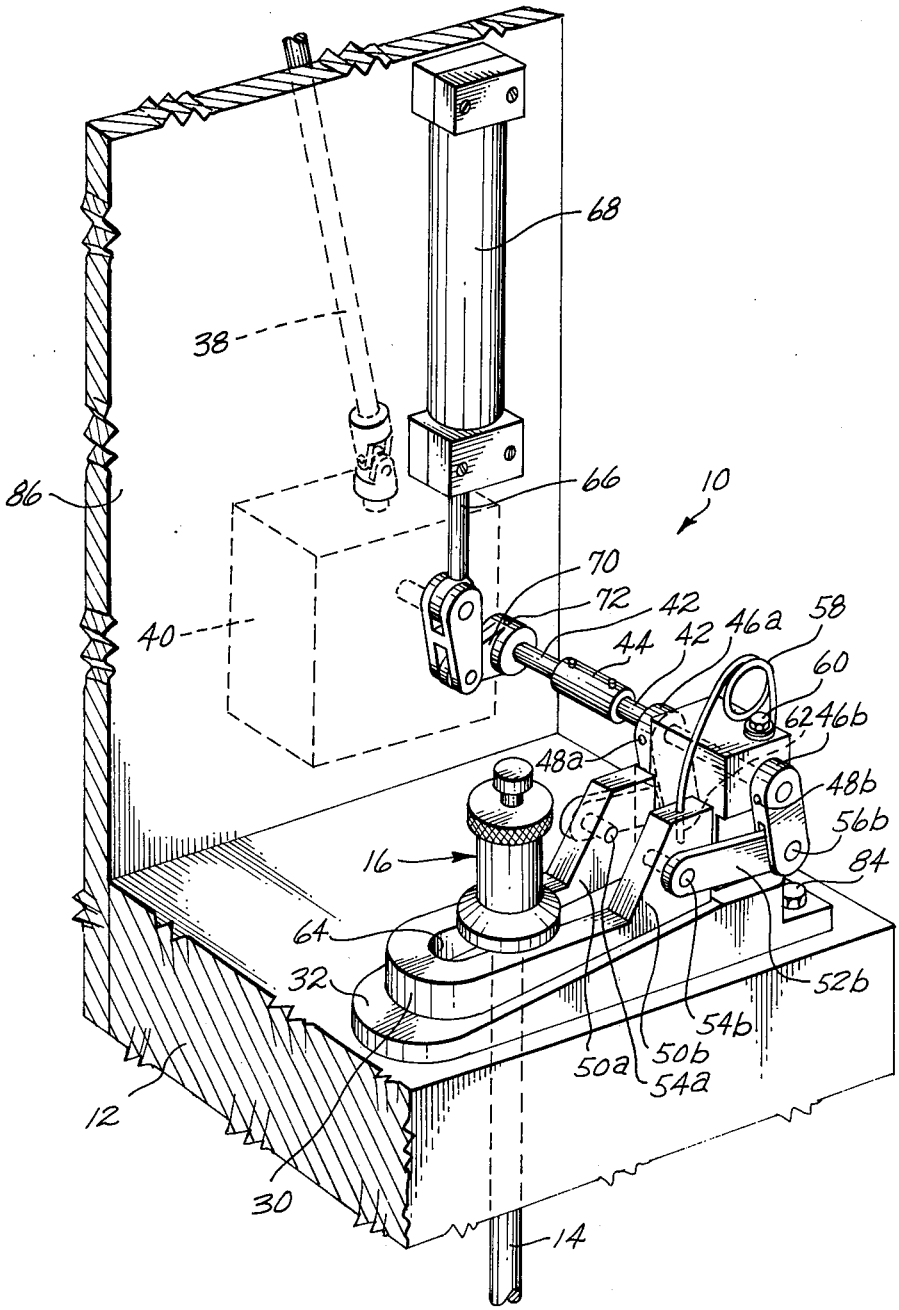
Fig. 1
Fig. 4
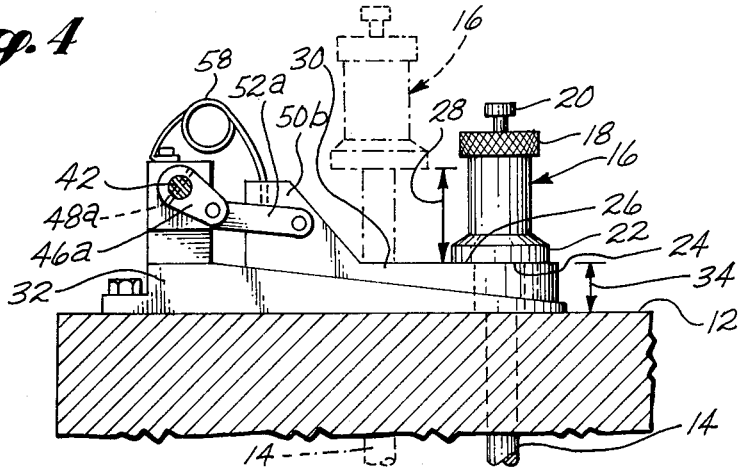

REMOTE CONTROL COUNTERSINK ADJUSTMENT

BACKGROUND OF THE INVENTION when a hole for fasteners requires a countersink the depth of the countersink is critical in order for the top of the head of the installed fastener to be flush with the surrounding area. To obtain proper depth in a countersink when using an automatic riveting machine the adjustment for depth is made by hand; requires, from a safety standpoint, that power be turned off the equipment; and when joining large parts requires climbing up to the unit, all of which takes time. It has been found adjustment for countersink depth may be accomplished accurately and rapidly using the remote control equipment of this invention.

SUMMARY OF THE INVENTION

A reversible motor is energized to drive a shaft. Linkage from the shaft moves a wedge back and forth to vary the height of an upper surface of the wedge, which surface acts as a stop to control the depth of travel of a countersink tool. Linkage from the shaft simultaneously drives a rod back and forth to act on a transducer to generate and send an electric signal to a digital readout showing the change in heighth of the upper surface of the wedge.

It is an object of this invention to provide a device giving remote control adjustment of countersink depth on an automatic riveting machine.

DESCRIPTION OF THE DRAWINGS

FIG. 1 shows a fragmented perspective view of the apparatus of this invention.

FIG. 4 is a sectional view taken along line 4—4 of FIG. 3.

DETAILED DESCRIPTION

Figure 3:
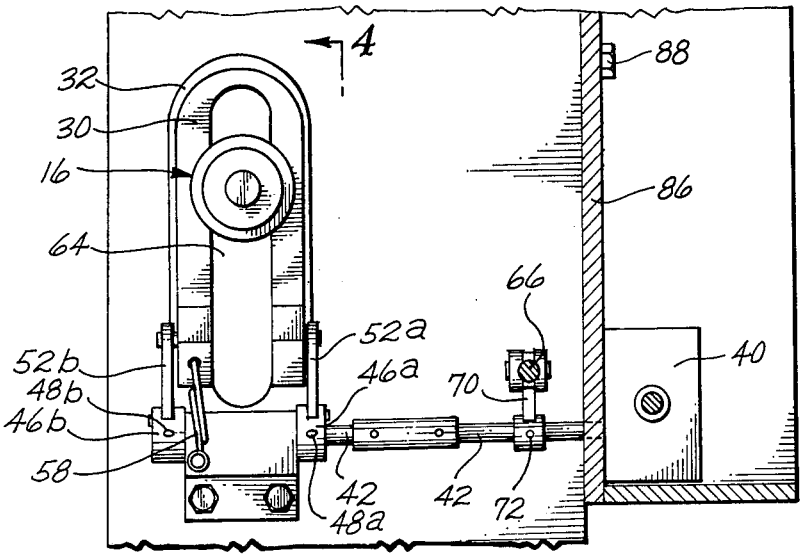
FIG. 3 shows a sectional view taken along line 3—3 of FIG. 2.
Figure 2:
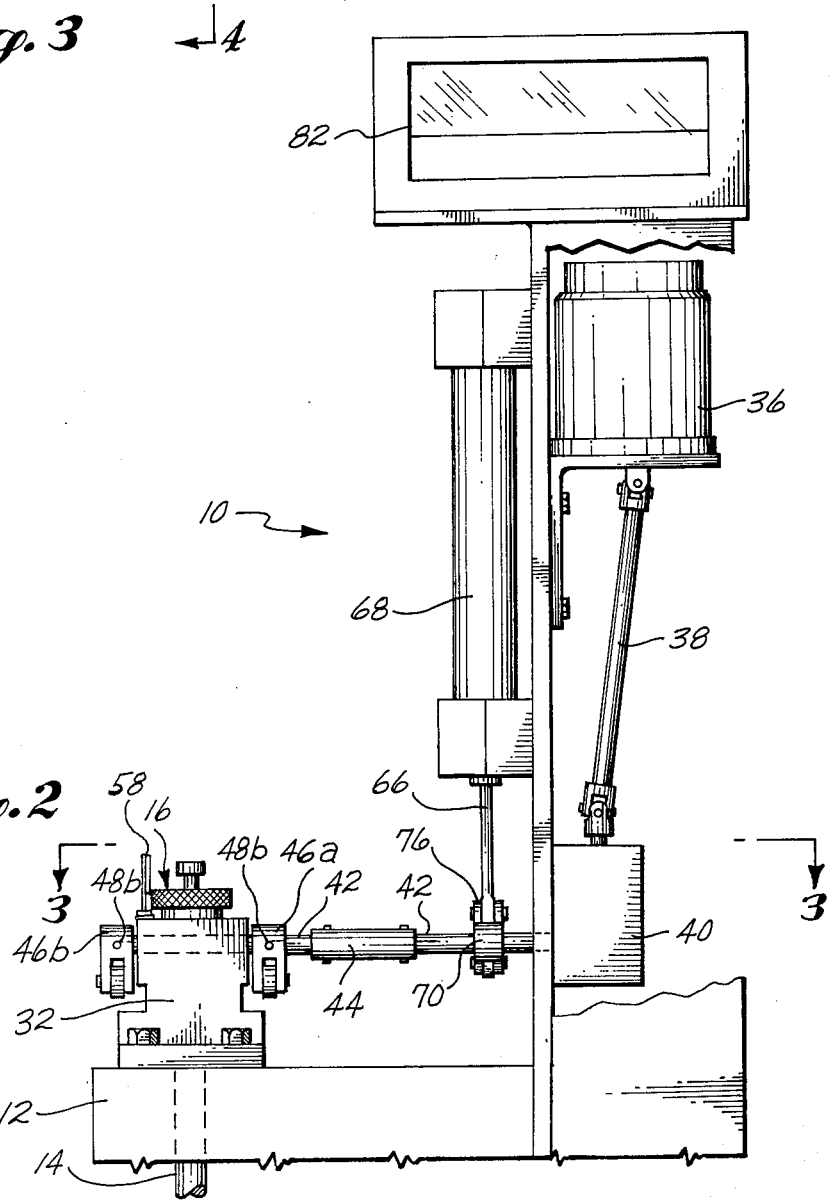
FIG. 2 shows a front elevational view of the apparatus of FIG. 1.
Figure 5:
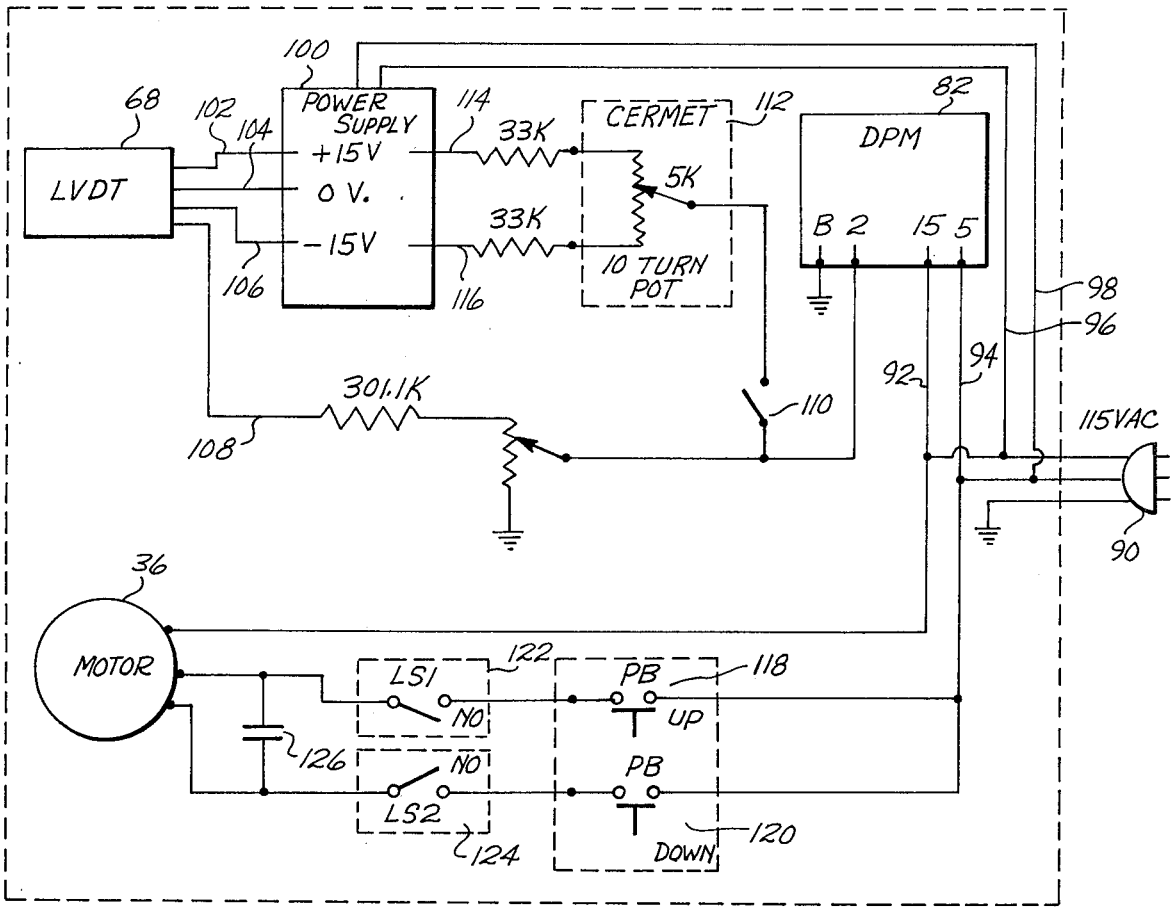
FIG. 5 shows a schematic of the electrical circuit for this apparatus.

An adjustment control apparatus 10 is mounted to the structure 12 of an automatic riveting machine to give remote control adjustment of the depth of travel of the riveting machine drill and countersink spindle 14, to thereby control countersink depth. Operation of an automatic riveting machine is well know and additional details of the machine will not be shown. On the end of the spindle is an adjustable stop 16; which has a knurled knob 18 for adjusting the stop up or down on the spindle, locking screw 20 and a shoulder 22 to extend out and provide a surface 24 which contacts a stop limiting surface 26 to control the depth of travel 28 of the spindle. The stop limiting surface is the top surface of an upper wedge 30 which reciprocally moves back and forth on a lower wedge 32 to raise or lower the heighth 34 of the upper surface to control the depth of travel of the spindle.

Movement of the upper wedge 30 is accomplished with a reversible motor 36 acting through universal drive 38 and gear box 40 to rotate drive shaft 42. The drive shaft is segmented and joined together by coupling 44 to extend through the lower wedge 32 which acts as a bearing to permit free rotation of the shaft. A pair of yokes **46*a* and 46*b* are secured to the drive shaft with pins 48*a* and 48*b*, respectively. Projections 50*a* and 50*b* of the upper wedge are linked to the drive shaft with pivotally mounted arms 52*a* and 52*b* by use of pins 54*a* and 54*b* at the wedge end of the arms, and by pins 56*a* and 56*b* at the yoke ends of the arms. The upper wedge is kept against the lower wedge by torsion spring 58 which is joined to the upper wedge with fastener 60 and extends with the other end of the spring pressing into a hole 62 in the upper wedge 50*b*. Both of the wedges are slotted at 64** to permit the retracted spindle to move laterally as is required with an automatic riveting machine.

The drive shaft 42 simultaneously drives a rod 66 back and forth with the drive shaft rotation, to act on a linear voltage dividing transducer 68. Connection of rod 66 to the drive shaft is accomplished with link 70 fastened to the drive shaft with set screw 72, and the link is pivotally joined at 74 to double yoke linkage 76; which in turn is pivotally pinned at 78 to an enlarged end 80 of the rod 66. The linkage is sized to impart a movement to rod 66 that is relative to the upper wedge movement, and the transducer converts said movement into an electrical signal that is equivalent to the change in heighth of the upper surface 26 of the upper wedge 30. This change in heighth due to the signal is shown as a readout on digital panel meter 82.

To install the adjustable control apparatus 10, the adjustable stop 16 is removed, the lower wedge 32 fastened to the structure 12 of the automatic riveting machine with bolts 84, the drive and readout portion of the apparatus fastened to housing 86, the housing fastened to the structure with bolts 88, and the adjustable stop replaced.

Next the spindle 14 is advanced to give the desired depth of countersink with the adjustable stop 16 contacting the upper surface 26 of the upper wedge 30. Electrical connector 90 is plugged into an electrical outlet (not shown) to energize the control circuits, the current flows through lines 92 and 94 to energize the digital panel meter 82. The current flows through line 96 and 98 to power supply 100 which converts the alternating current input to a direct current output which preferably is at plus or minus 15 volts. This current flows through lines 102, 104 and 106 to energize the linear voltage transducer 68. The transducer generates an output signal which flows over line 108 to light up a digital readout on meter 82 with the readout showing a zero setting; so that any further change in mechanical input to the transducer will produce an electrical signal that will directly read a plus or a minus figure on the readout. If, for any reason, it is desired to drift the reference depth of the countersink the upper wedge is moved to position the stop surface at the desired location, switch 110 is turned on and potentiometer 112 adjusted until the readout on the digital panel meter shows a zero setting. Low voltage direct current flows from the power supply converter 100 over lines 114 and 116, and the potentiometer controls that voltage to set the meter. The reversible motor 36 is selectively controlled with up or down push buttons 118 and 120 and with limit switches 122 and 124 and capacitor 126.

In operation, and as required to change a countersink depth, an operator decides the amount of change needed and presses the up or down button until the readout shows the desired change has been accomplished.

We claim:

1. A device for remote control of countersink depth on an automatic riveting maching comprising: a reversible motor, a shaft driven by the motor, a pair of wedges mounted one on top of the other with the wedges having aligned slots, linkage extending from the shaft to reciprocally move the upper wedge in response to motor rotation to vary the heighth of the upper surface of the upper wedge, a second linkage extending from the shaft to reciprocally drive a rod a distance relative to the movement of change in the wedge as the shaft rotates, means for converting rod movement into an electrical signal for a readout to directly show heighth change in the wedge, and the wedges located to accept a spindle of an automatic riveting machine through the slots and the top surface of the upper wedge to act as a stop for downward movement of the spindle to control countersink depth.

2. A device for remote control of countersink depth on an automatic riveting machine as in claim 1 wherein the means for converting rod movement into an electrical signal for readout comprises a linear voltage dividing transducer and a digital panel meter readout.

3. A device for remote control of countersink depth as in claim 2 further comprising means for adjusting the readout meter to a zero setting at various wedge surface heighth positions.

* * * * *